United States Patent [19]

Golay

[11] Patent Number: 4,739,706

[45] Date of Patent: Apr. 26, 1988

[54] FUSE FOR PROJECTILE

[75] Inventor: Jean-Pierre Golay, Viry, France

[73] Assignee: Mefina S.A., Fribourg, Switzerland

[21] Appl. No.: 41,075

[22] PCT Filed: Jun. 12, 1986

[86] PCT No.: PCT/CH86/00085

§ 371 Date: Mar. 12, 1987

§ 102(e) Date: Mar. 12, 1987

[87] PCT Pub. No.: WO87/00616

PCT Pub. Date: Jan. 29, 1987

[30] Foreign Application Priority Data

Jul. 12, 1985 [CH] Switzerland ..... 3024/85

[51] Int. Cl.[4] ..... F46C 9/02; F46C 9/14; F46C 15/24

[52] U.S. Cl. ..... 102/271; 102/251; 102/255; 102/268

[58] Field of Search ..... 102/249, 248, 247, 271, 102/270, 251, 255, 256, 221, 266, 268

[56] References Cited

U.S. PATENT DOCUMENTS

| | | | |
|---|---|---|---|
| 2,644,398 | 7/1953 | Rabinow | 102/226 |
| 2,709,962 | 6/1955 | Funk et al. | 102/249 |
| 2,762,304 | 9/1956 | King et al. | 102/226 |
| 2,763,213 | 9/1956 | Rueger | 102/249 |
| 3,530,796 | 9/1970 | Kaiser et al. | 102/249 X |
| 4,154,169 | 5/1979 | Petiteau | 102/255 X |
| 4,215,635 | 8/1980 | Farace | 102/255 X |
| 4,389,937 | 6/1983 | Golay et al. | 102/255 X |
| 4,464,991 | 8/1984 | Kaiser | 102/255 X |

FOREIGN PATENT DOCUMENTS 210217 9/1940 Switzerland .

*Primary Examiner*—David H. Brown

*Attorney, Agent, or Firm*—Gifford, Groh, VanOphem, Sheridan, Sprinkle and Dolgorukov

[57] ABSTRACT

A fuse comprises a cap carrying a rotor mounted in a rotatable fashion on a body with the help of a shaft and rotatable from an inactive position to an active position. A timer with an escapement permits the braking of the rotation of the rotor and has a multiplying gear carried by two frames and cooperating with a timing balance. The rotor is an integral part of a toothed sector meshing with the timer. The frames are mounted in a pivoting fashion on bearings of a shaft, which permits the angular displacement of the timer around this shaft to allow for the adjustment of the angular distance of meshing of the toothed sector with the timer and, therefore, the duration of passage from the safety position of the rotor to the armed position.

10 Claims, 2 Drawing Sheets

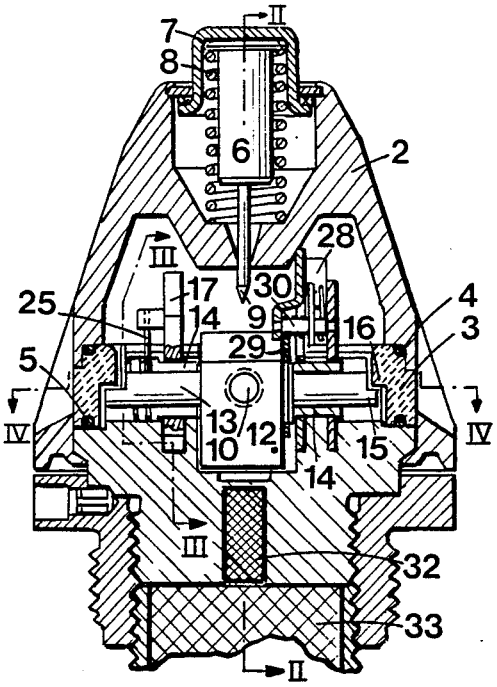
FIG. 1
FIG. 2
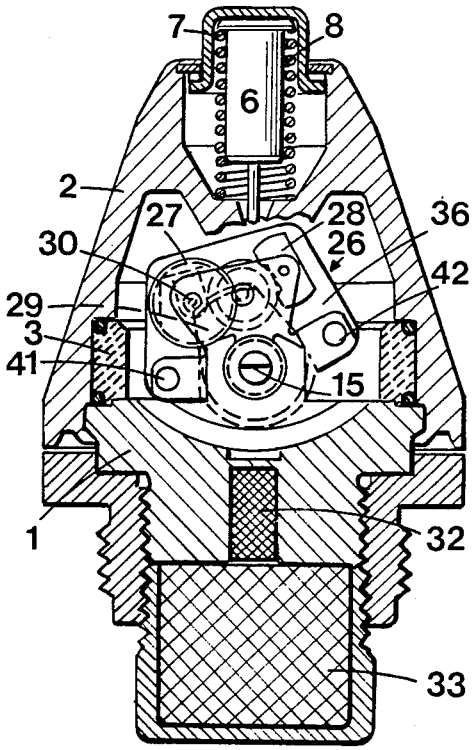
FIG. 3
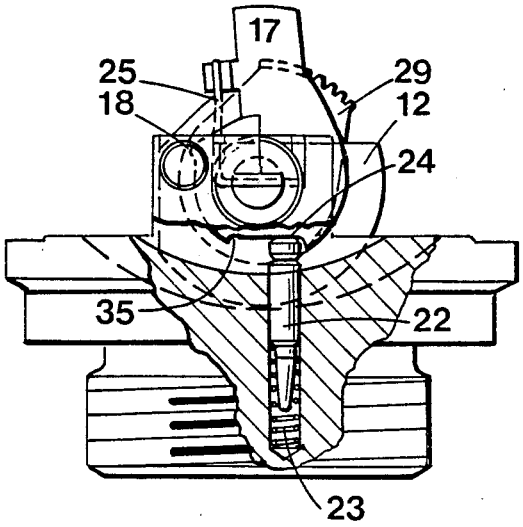

FUSE FOR PROJECTILE

BACKGROUND OF THE INVENTION

The object of the invention is to provide a fuse projectile with a detonator and a weapon safety comprising a body covered with a cap, a firing pin acting upon a firing cap during impact, an arming mechanism comprising a movable part arranged to assume first a safety position in which the cooperation between the firing pin and the firing cap is not possible and then an armed position allowing this cooperation, a mechanical timing element with an escapement for adjusting the duration of time of the movable part in the armed position, this timer meshing with a toothed part of the movable part to vary the duration of the time that it takes for the fuse to pass from the safety position to the armed position.

A fused of this kind is already known by the U.S. Pat. No. 2,644,398 in which the means for varying the time it takes for the fuse to pass from the safety position to the armed position has a differential gear mechanism for the purpose of varying the initial position of a movable part which must be brought into the final arming position. This mechanism is complicated and expensive.

SUMMARY OF THE INVENTION

The present invention has the purpose of creating a rugged, simple and inexpensive device, for permitting the adjustment of the passage time of the movable part from an initial safety position to a final arming position.

For this purpose the fuse of the object invention is characterized in that the timer is made to be adjustable in order to change its position along a toothed part for the purpose of modifying the distance over which it will mesh with the toothed part before the movable part will reach its armed position.

BRIEF DESCRIPTION OF THE DRAWINGS

The attached drawing represents schematically and as an example a form of implementation of the object fuse of the present invention.

FIG. 1 is a axial section of the fuse of the present invention.

FIG. 2 is a section following a line II—II of FIG. 1.

FIG. 3 is a partial section along a line III—III of FIG. 1.

DETAILED DESCRIPTION OF A PREFERRED EMBODIMENT OF THE INVENTION

Figure 4:
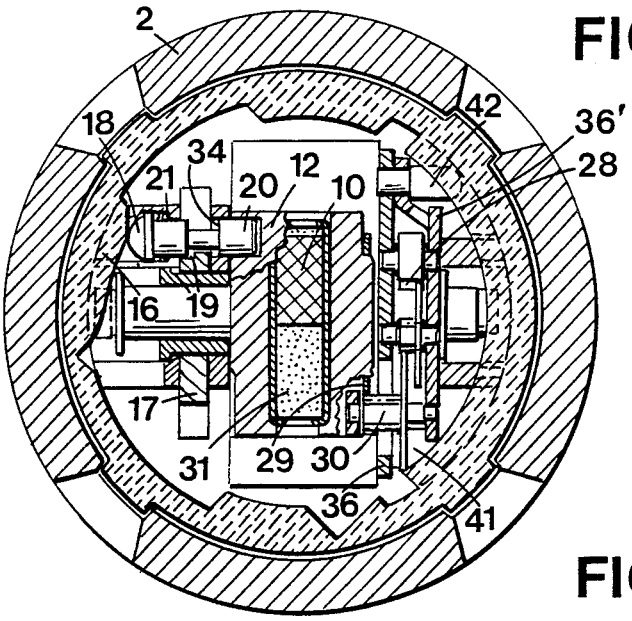
FIG. 4 is a cross section following a line IV—IV of FIG. 1.

The fuse comprises a body 1 on which is mounted a cap 2 which can be displaced angularly with respect to the body 1 by a ring 3 which has a cam form provided with two ring gaskets 4 and 5 and whose operation will be described later.

The front part of the cap 2 carries a firing pin 6 which is urged towards a caplet 7 by a spring 8 and which is provided with a firing cap 10 carried by a rotor 12, the latter is represented on FIG. 1 in the safety position in which the firing cap 10 is placed outside the trajectory of the tip 9 of the firing pin 6. The rotor 12 is an integral part of a shaft 13 pivoting in bearings 14 carried by the body 1. The end of the shaft 13 is provided with a flat piece 15 facing a flange 16 of the ring 3 when the ring 3 is in the safety position produced by the angular position of the cap 2.

The angular displacement of the rotor 12 permitting the firing cap 10 to be brought into the operating position is controlled by a device shown clearly on FIGS. 3 and 4.

This device comprises an inertial lever 17 mounted on one of the bearings 14. This inertial lever 17 has its center of gravity eccentric with respect to the axis of the shaft 13 and is maintained in its safety position shown in FIGS. 3 and 4 by a lock 18 placed in a slot 19 of this lever as well as in another slot 20 on rotor 12. The lock 18 is retracted by a spring 21 towards the interior of the projectile, but it is maintained in its position by a flange 16 of the ring 3 when the latter is in the safety position. Furthermore, the lever 17 is subjected to the action of a pushing finger 22 urged by a spring 23, applying the finger 22 against a recess 24 formed in the lever 17.

A torsion spring 25, wound on the shaft 13 of the rotor 12 is attached, by one of its ends, to the lever 17 and by the other end to the shaft 13. The spring 25 is designed to provide the driving couple for turning the rotor 12 after the shot has been fired and to bring it into active position, allowing the tip 9 of the firing pin 6 to move and strike the firing cap 10. The rotation of the rotor 12 is braked by an escapement timer 26 which includes a gear multiplier 27 (FIG. 2) operating together with a balance 28. The start of the mechanism is made by a gear sector 29 (FIG. 1) which is attached to the rotor 12 and which meshes with a toothed pinion 30 of the mechanism.

Figure 5:
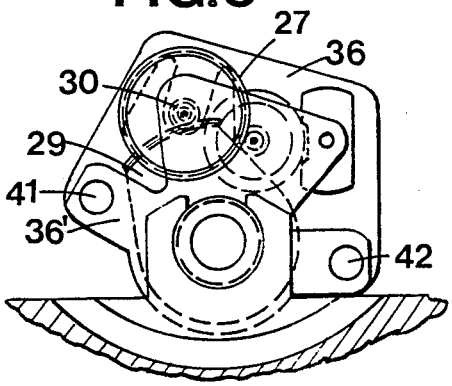
FIG. 5 is a partial view of FIG. 2, showing a different operating position.

The timer 26 has frames 36 and 36' which pivot on the bearings 14 of the shaft 13 and which allows angular displacement of the timing device around the shaft 13. Two timing periods are given by two different positions of the timing device as shown on FIG. 2 and FIG. 5. In the case of FIG. 2, the rotor 12 must turn in the counterclockwise direction in order to assume the armed position. The sector gear 29 meshes through the total length of its gear teeth during this angular displacement. A short time before the end of this movement, gear sector 29 escapes from the pinion 30 and the rotor 12 assumes its final position. In the case of FIG. 5, the position of the timing device is such that the meshing of the gear sector 29 with the pinion 30 is made in the safety position of the rotor 12, close to the end of the gear teeth end of the gear sector 29. Thus, during the angular displacement of the rotor 12, only a few gear teeth of the sector 29 will work together with the pinion 30 before the sector 29 escapes from the pinion 30. The rotor 12 is, therefore, braked on a shorter travel which obviously results in a shorter timing duration.

Figure 6:
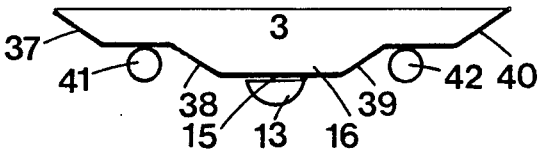
FIGS. 6 and 7 illustrate the control device.
Figure 7:
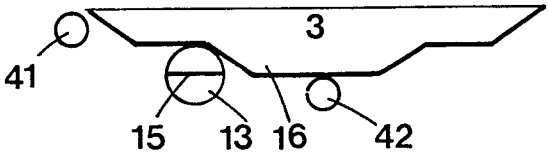

The positioning of the timing device in the desired position is obtained through adjustment of the ring 3 which has ramps 37 through 40 shown schematically in FIGS. 6 and 7. These ramps 37–40 operate together with two nipples 41 and 42 of the timing device in order to bring it to one or the other of the positions shown in FIGS. 2 and 5. FIG. 6 shows the ramps 37–40 in the safety position of the ring 3 for which the timing device assumes an average position between the two extreme positions. If ring 3 is turned to displace the ramps 37–40 to the right, the ramp 39 will work together with the nipple 42 in order to shift the timing device to the position shown in FIG. 5. A rotation of the ring 3 in the opposite direction will bring the timing device to the position shown in FIG. 2 by the cooperation of the ramp 38 with the nipple 41.

The operation of the fuse is as follows:

Before loading the weapon with the projectile, the ring 3 must be rotated for example with the help of the cap 2 to disengage the flange 16 from the flat parts 15, the ring 2 being turned in one direction or the other in order to shift the timing device to one of the chosen positions.

During rotation of the ring 3, the flange 16 frees the lock 18 so that the latter moves through the first part of its travel which unlocks the inertial lever 17 by disengaging from the slot 19.

Because of the bearing 34 of the lock 18, the displacement is limited by a stop of that bearing 34 against the lever 17 so that one end of the lock 18 is engaged in the slot 20.

The acceleration to which the projectile is subjected at the start of the firing of the weapon displaces the pushing finger 22 (FIG. 3) against the action of the spring 23 for the purpose of allowing the lever 17 to turn by inertia in the clockwise direction, in reference to FIG. 3, against the spring 25.

When the lever 17 has made a rotation of a $\frac{1}{4}$ turn approximately, the lever 17 engages the lock 18 completely with a notch 35 provided on the lever 17 and in which the lock 18 engages in order to lock the lever 17 in the armed position. The rotor 12 is then unlocked and turns through the effect of the driving couple of the spring 25. This displacement is timed by the timing mechanism 26 to the selected value. As soon as the rotor 12 has made an angular displacement of approximately $\frac{1}{4}$ of a turn, the duration of the displacement having been foreseen in order to insure the safety position of the weapon, the firing cap 10 is facing the tip 9 of the firing pin 6, while a reinforcing relay 31 carried by the rotor places itself in front of a pyrophoric relay 32 and a detonator 33.

I claim:

1. A projectile fuse with detonator and weapon safety comprising a body covered by a cap, a firing pin to operate on a firing cap on impact, an arming mechanism comprising a movable part displaceable from a safety position to an armed position, a mechanical timer with escapement means to adjust the duration of time for the passage of the movable part from the safety position to the armed position, the movable part having gear teeth and the timer meshing with the gear teeth of the movable part, the timer varying the duration of the passage from the safety position to the armed position, characterized in that the timer is displaceable in a manner to change its position on the length of the gear teeth for changing the distance on which it cooperates with the gear teeth before the movable part arrives at the arm position.

2. A fuse according to claim 1, comprising a rotor carrying the firing cap and angularly displaceable to assume the arm position, characterized in that the rotor is an integral part of a toothed sector of the gear teeth for meshing with a toothed pinion of the timer, the pinion being angularly displaceable for establishing the angle of meshing which the toothed sector must travel before arriving at the armed position.

3. A fuse according to claim 2 characterized in that the angular displacement of the timer is controlled by a rotating ring mounted to the cap and carrying a cam cooperating with the timer.

4. A fuse according to claim 3 characterized in that the ring is made of an added part forming an integral part of the cap.

5. A fuse according to claim 4, characterized in that the timer is provided with two nipples cooperating with the said cam.

6. A projectile fuse having a detonator and a weapon safety comprising:

a body;

a cap movably mounted to the body;

a firing cap mounted within the cap;

a firing pin movable axially within said cap to operate on the firing cap upon impact of the projectile fuse; and an arming mechanism mounted with the cap comprising:

a movable part angularly displaceable between a safety position and an armed position, the movable part having a gear sector, a mechanical timer having an escapement and a gear member for controlling the angular displacement of the movable part between the safety position and the armed position, the gear member selectively positionable along the gear sector to establish a predetermined length of travel for the gear sector to the safety position, and means for selectively positioning the gear member on the gear sector to vary the angular displacement of the gear sector to the armed position thereby correspondingly varying the duration of time for passage to the armed position.

7. The fuse according to claim 6, comprising: a rotor carrying the firing cap, the rotor being angularly displaceable to assume the armed position, the rotor being integrally formed with the movable part, the gear member of the timer being a toothed pinion, the pinion being angularly displaceable for variably determining the angle of meshing along the gear sector before arriving at the armed position.

8. The fuse according to claim 7 wherein the means for selectively positioning comprises a rotating ring mounted to a cam cooperating with the timer for controlling the angular displacement of the timer.

9. The fuse according to claim 8 wherein the rotating ring is an integral part of the cap.

10. The fuse according to claim 9, wherein the timer has two nipples cooperating with the cam.

* * * * *